US009718209B2

(12) United States Patent
Hatch

(10) Patent No.: US 9,718,209 B2
(45) Date of Patent: Aug. 1, 2017

(54) TABLE SAW GUIDE AND SAFETY GUARD

(71) Applicant: The Boeing Company, Chicago, IL (US)

(72) Inventor: Tyler C. Hatch, Salt Lake City, UT (US)

(73) Assignee: The Boeing Company, Chicago, IL (US)

( * ) Notice: Subject to any disclaimer, the term of this patent is extended or adjusted under 35 U.S.C. 154(b) by 314 days.

(21) Appl. No.: 14/288,262

(22) Filed: May 27, 2014

(65) Prior Publication Data

US 2015/0343586 A1 Dec. 3, 2015

(51) Int. Cl.
*B27G 19/02* (2006.01)

(52) U.S. Cl.
CPC ..... *B27G 19/02* (2013.01); *Y10T 29/49828* (2015.01); *Y10T 83/732* (2015.04)

(58) Field of Classification Search
CPC ..... B27B 25/10; B27G 19/02
USPC ..... 83/431, 437.11–436.2, 435.11, 83/437.3–437.7, 440.2
See application file for complete search history.

(56) References Cited

U.S. PATENT DOCUMENTS 4,346,634 A * 8/1982 Jones ..... B26D 3/185 83/404.3
4,625,604 A 12/1986 Handler
5,875,827 A * 3/1999 Brutscher ..... B27B 25/10 144/253.1
7,127,976 B1 * 10/2006 Fitzsimmons ..... B23D 47/045 144/204.2
7,255,144 B2 * 8/2007 Smith ..... B23Q 3/007 144/253.1
7,997,313 B2 * 8/2011 Wang ..... B23Q 1/262 144/286.1
8,245,612 B2 8/2012 Chung
2003/0233926 A1 * 12/2003 Makropoulos ..... B23D 47/02 83/829
2008/0047411 A1 2/2008 Cao
(Continued)

OTHER PUBLICATIONS

"Magnetic Table Saw Blade Guard," www.lumberjocks.com/projects/38747, Aug. 1, 2013.

(Continued)

*Primary Examiner* — Andrea Wellington
*Assistant Examiner* — Fernando Ayala
(74) *Attorney, Agent, or Firm* — Ostrager Chong Flaherty & Broitman P.C.

(57) ABSTRACT

A guide and safety guard for a table saw, of the type having a table top and a powered saw blade with an exposed saw blade portion projecting above the table top and a movable guide fence positionable on the table top on a far side of the saw blade, has a support rail having opposite ends coupled to support members in a desired spaced relation to the guide fence of the table saw, a guard block mounted by a sleeve portion so as to be slidable on the support rail in axial directions thereon, and rotatable on the support rail so that it can be moved out of and into operative position, wherein the guard block has a height projecting above the table top in the operative position that is greater than the height of the exposed saw blade portion for protecting the hand of the user, and a guard extension fixed to a trailing side of the guard block for protecting the wrist and lower arm area of the user.

15 Claims, 5 Drawing Sheets

(56) References Cited

U.S. PATENT DOCUMENTS

| | | | | |
|---|---|---|---|---|
| 2011/0162500 | A1* | 7/2011 | Frolov | B23D 59/006 83/100 |
| 2012/0116219 | A1* | 5/2012 | Miller | A61B 8/4254 600/438 |

OTHER PUBLICATIONS

Axminster Hobby Series BTS10ST Table Saw, www.axminster.co.uk/axminster-hobby-series-bts10st-table-saw-prod886278/, Aug. 1, 2013.

"Woodworking eTool," United States Department of Labor, OSHA, https://www.osha.gov/SLTC/etools/woodworking/table__1.html, Aug. 1, 2013.

* cited by examiner

TABLE SAW GUIDE AND SAFETY GUARD

TECHNICAL FIELD

This disclosure generally relates to a safety assembly for a table circular saw. In particular, it is directed to a safety assembly for guiding movement of a workpiece in precise relation to a circular saw blade while protecting the user's hand from injury.

BACKGROUND

Table saws are widely used in tool shops and on job sites for powered cutting or trimming of construction items in a wide range of applications. Power saw cutting can include close or precise trimming of small amounts of excess material from a workpiece. An ever-present concern is safety in using the saw blade, which is very sharp and moving at a high rate of speed. Severe injuries such as severed fingers or deep lacerations can occur accidentally to the hand of a user handling a workpiece on a table saw almost instantaneously.

Various safety systems in particular for circular saws have been developed to reduce the dangers of working with an exposed blade rotating at high speed. Blade guards have been designed to enclose the area proximate a saw blade while allowing a workpiece to pass under it in order to prevent injuries to the user. An example of a blade guard assembly for a table circular saw is described in U.S. Pat. No. 4,625,604 to Handler et al., issued Dec. 2, 1986. However, such blade guards may prevent a user from precisely manipulating a workpiece close to the cutting edge of the blade and therefore detract from the user's accuracy in cutting or trimming a workpiece.

Some table saw systems also provide a guide or fence on the table top for aligning a workpiece for precise movement through the position of the saw blade in conjunction with using a conventional blade guard to prevent injuries. An example of a table saw with a combination of guide fence and blade guard is commercially available from Axminster Tool Centre, United Kingdom, under the product name Axminster Hobby Series BTS10ST table saw, which offers a rip fence on support rails with a flip-over function so that it can act either as a fence or wide board support rail. However, while the rip fence can maintain the edge of the workpiece to be cut or trimmed in spaced relation to the position of the saw blade, it does not allow the user to precisely manipulate the workpiece itself close to the position of the saw blade, particularly for a workpiece that may have a complex contour or three-dimensional shape.

Other table saw safety systems have been developed which are intended to drop the blade below the surface of the table saw if the user releases a brake latch, such as by releasing a foot from a safety pedal. An example of a power saw safety latch is described in U.S. Pat. No. 8,245,612 to Chung et al., issued Aug. 21, 2012. However, even a slight delay in releasing the latch can result in serious injury.

It would therefore be advantageous to provide a table saw safety system that allows a user to manipulate a workpiece close to the position of a saw blade while protecting the user's hand from risk of accidental contact with the saw blade.

SUMMARY

In accordance with a preferred embodiment in the present disclosure, a guide and safety guard for a table saw, of the type having a table top and a powered saw blade with an exposed portion of the saw blade projecting a given height above the table top for cutting a workpiece thereon, and a movable guide fence positionable on the table top on a far side of the saw blade for guiding a far edge of the workpiece to be cut by the saw blade, the guide and safety guard comprising:

a support rail having opposite ends coupled to respective support members that are configured to be coupled on a near side of the saw blade in a desired spaced relation to the guide fence of the table saw positioned on a far side of the saw blade;

a guard block mounted by a sleeve portion so as to be slidable on the support rail in axial directions thereon, and rotatable on the support rail so that it can be moved out of and into operative position to enable a user to press down manually on the workpiece, said guard block having a height projecting above the table top in the operative position that is greater than the height of the exposed portion of the saw blade for protecting the hand of the user pressing down thereon; and a guard extension fixed to a trailing side of the guard block having an extension length for protecting the wrist and lower arm area of the user. In the preferred embodiment, the guard block has a width W that is less than the trimmed width of the part but wide enough to allow manipulation close to the position of the saw blade. The guard block may be formed as one of a set having varying widths in increments. Alternatively, the guard block may be formed with an end portion that is adjustable in width.

In an alternate embodiment, the guard block may have a base portion and an adjustable portion with a slightly smaller length so that it can be telescoped within the housing of the base portion. Set screws on opposite sides of the base portion may be used to fix the adjustable portion in position for a desired total width of the guard block. The guard extension is attached to the adjustable portion and has a cutout portion for clearance around the housing of the base portion.

The disclosure herein also encompasses a method of using the guide and safety guard to protect the hand and wrist area of the user when cutting a workpiece with a table saw. The disclosed guide and safety guard assembly may also be modified for use with a band saw by providing the guard block with a vertical flange extending upward a height sufficient to protect the hand of the operator from the side.

Other objects, features, and advantages of the various embodiments in the present disclosure will be explained in the following detailed description with reference to the appended drawings.

DETAILED DESCRIPTION

In the following detailed description, certain preferred embodiments are described to illustrate the principles in the present in the context of a specific application environment in the aircraft industry. It will be recognized by one skilled in the art that the present disclosure may be practiced in other analogous applications or environments and/or with other analogous or equivalent variations of the illustrative embodiments. It should also be noted that those methods, procedures, components, or functions which are commonly known to persons of ordinary skill in the field of the invention are not described in detail so as avoid unnecessarily obscuring a concise description of the preferred embodiments.

In precision manufacturing, such as in the aircraft construction industry, formed parts may need to be trimmed by a small amount, such as a few thousandths of an inch, in order to properly fit to precise tolerances. To make these precise trims, a part that has been formed by a stock cutting or shaping operation may typically need to be trimmed in a precision milling machine in a process that may take several hours. For some types of parts, a fabricator may prefer to make the trims using a table circular saw because it is faster than having to send the part to a milling machine. In some cases, trimming with a table saw may be more precise than using a milling machine. However, using a table saw for trimming requires a safety system that will allow the user to precisely manipulate the part in relation to the saw blade while protecting the user's hand from risk of injury.

Figure 1:
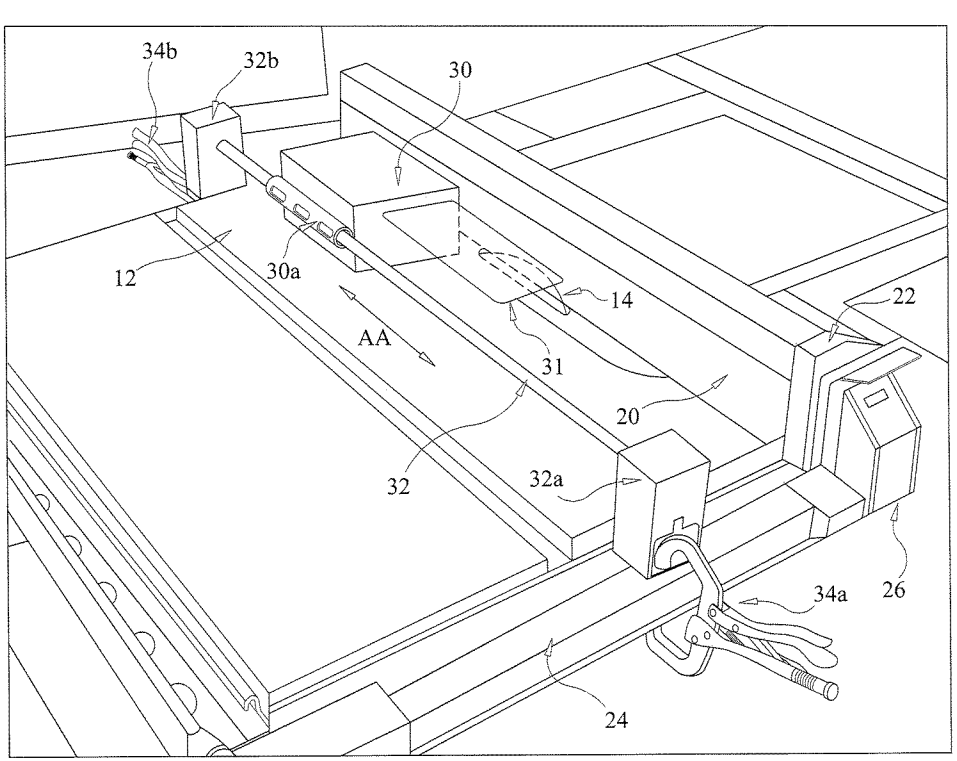
FIG. 1 illustrates a preferred embodiment of a guide and safety guard for use with a conventional table circular saw.

Referring to FIG. 1, a preferred embodiment of a guide and safety guard for a conventional table circular saw is illustrated. The conventional table circular saw 10 has a table top 12 and a circular saw mounted below the table top with a portion of its saw blade 14 projecting vertically through a slot so as to project a desired height settable by the user above the table top 12 for cutting or trimming. Typically, the circular saw has a blade guard that is movable between an up position exposing the saw blade and a down position enclosing the exposed portion of the saw blade except for a gap under which the part to be cut or trimmed is passed. Instead of using the conventional blade guard (omitted in the figure), the preferred embodiment of a guide and safety guard is provided to allow the user to precisely manipulate the part in relation to the saw blade while protecting the user's hand from risk of injury.

The conventional table circular saw may have a movable guide fence 20 that can be positioned on the table top on the far side of the saw blade 14 for guiding the edge of the part to be cut or trimmed. The ends of the guide fence 20 are mounted to end members 22 supported on side rails 24 that are movable by a rack-and-pinion positioning mechanism 26 that is part of the conventional table saw assembly.

The preferred embodiment of a guide and safety guard, which is to be used in conjunction with the conventional guide fence, employs a guard block 30 which is mounted by a sleeve portion 30*a* so as to be slidable on a support rail 32 in axial directions AA, as well as rotatable on the support rail so that it can be moved out of and into operative position. The support rail 32 has its opposite ends coupled to support members 32*a*, 32*b*, respectively, which are individually movable and then coupled to the side rails 24, such as by clamping with clamps 34*a*, 34*b*, in a position spaced in relation to the guide fence 20 for the width of the particular part to be cut or trimmed. When the part is placed on the table top 12 with its far edge against the guide fence 20, and the support rail 32 is clamped in position, the guard block 30 is rotated down onto the upper surface of the part to allow the user to press the guard block 30 down on the part and precisely manipulate it while moving the part across the saw blade 14. The guard block 30 has a guard extension 31 for also protecting the wrist and lower arm area of the user (shown in the figure extending from the right side of the guard block for a right-handed user).

Figure 2A:
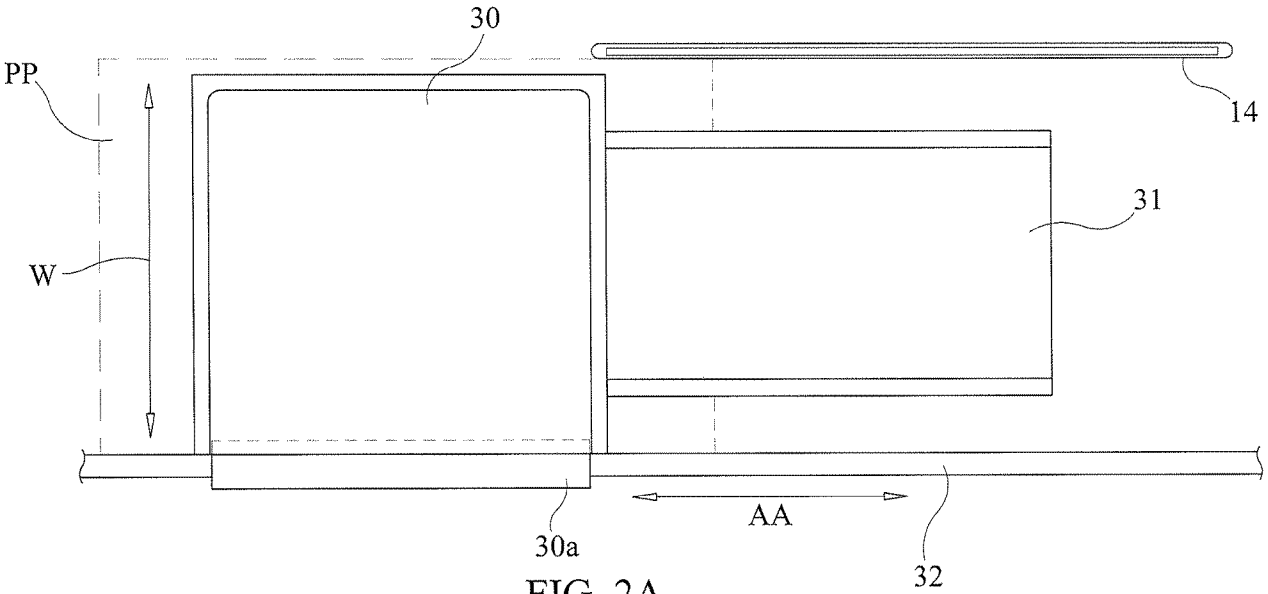
FIGS. 2A and 2B are plan and side views of the guard block and extension shown in operative relation to the exposed portion of the saw blade.

Referring to FIG. 2A, the guard block 30 and extension 31 are shown in plan view positioned on a part to be cut or trimmed PP in operative relation to the exposed portion of the saw blade 14. The guard block 30 is slidable by its sleeve 30*a* in axial directions AA on the support rail 32. The guard block 30 has a width W less than the trimmed width of the part PP but wide enough to allow manipulation close to the position of the saw blade 14. The guard extension 31 has a width that is about the same as W but recessed a small amount to allow the extension to clear the end member of the guide fence when the guard block is moved to that end. The guard block 30 may be formed as one of a set having varying widths in increments, such as 4 inches, 5 inches, 6 inches, etc. for cutting or trimming formed parts of standard widths in that range. Alternatively, the guard block may be formed with an end portion that is adjustable in width (alternate embodiment described below).

Figure 2B:
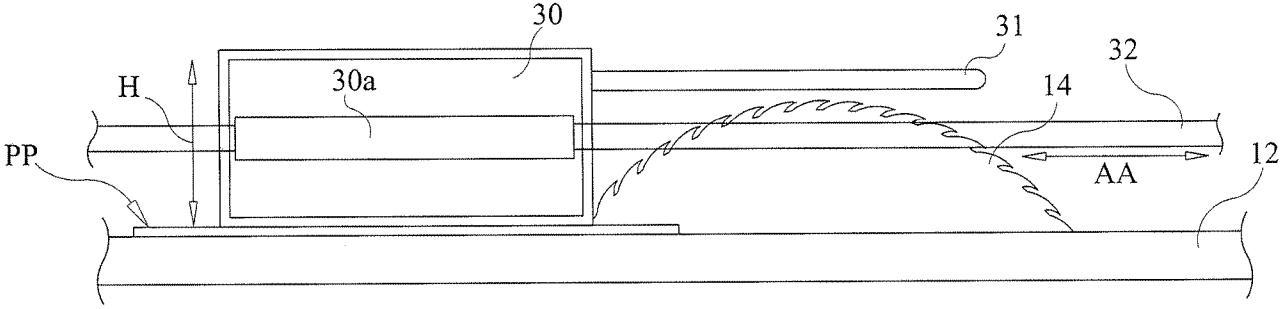

Referring to FIG. 2B, the guard block 30 and extension 31 are shown in side view in relation to the part PP and the exposed portion of the saw blade 14. The guard block 30 is formed with a height H greater than the exposed height of the saw blade to protect the user's hand when pressing on the part PP and moving it close to the position of the saw blade 14. The guard extension 31 is mounted to the guard block 30 at the same height H.

For use of the guide and safety guard, the distance between the fence and the saw blade is adjusted using the rack-and-pinion mechanism based on the amount of material to be trimmed from a formed part. The part is positioned against the fence, then the support rail for the guard block is positioned with the proper spacing for the part from the fence and clamped in position on both ends to the side rails of the rack-and-pinion mechanism. In this manner, the spacing between the guard assembly and the fence remains the same even if the position of the fence may be adjusted relative to the saw blade. The guard block rotated to the opened position is moved to a start end of the support rail, then the guard block is rotated down onto the part to hold it by pressure of the user's hand for stable movement across the saw blade. The saw blade is then turned on, and the user can push on the guard block past the saw blade to trim the part. The pressure and controlled movement of the guard block maintains the position of the part with respect to the fence to perform a precise cut without any deviations, and the guard block and extension prevents contact between the user's hand, wrist and lower arm area as the part is pushed past the saw blade. The guard assembly allows the user to make precise cuts without any second guessing about moving the part along the fence or worries about safety.

Figure 3A:
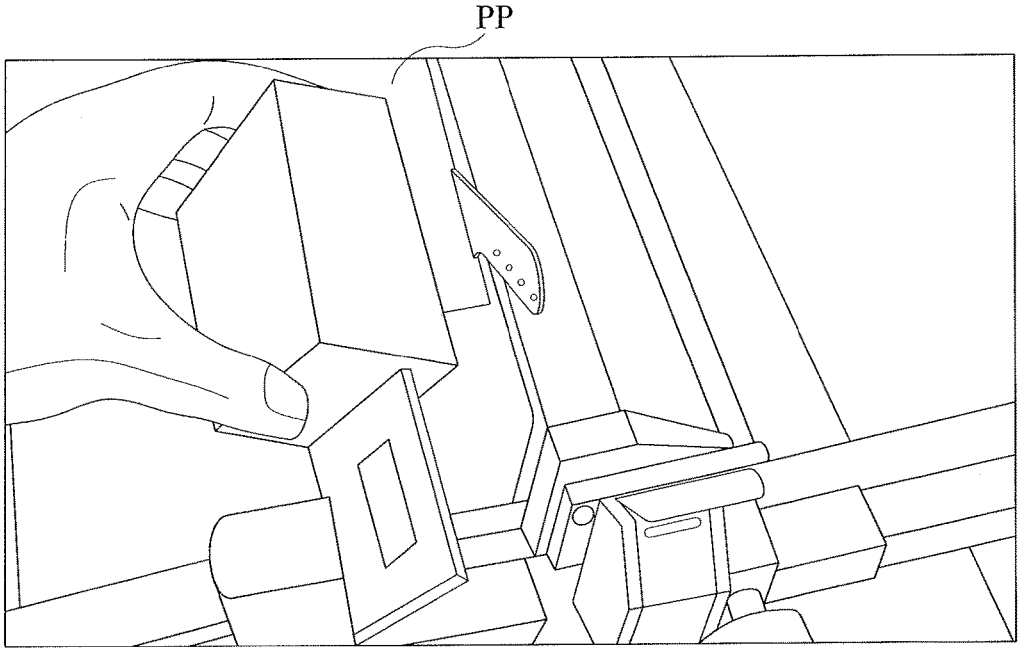
FIGS. 3A, 3B and 3C are a series of views showing the guard block and extension being rotated open to position the part, closed to press down on the part, and moved past the saw blade to trim the part, respectively.
Figure 3B:
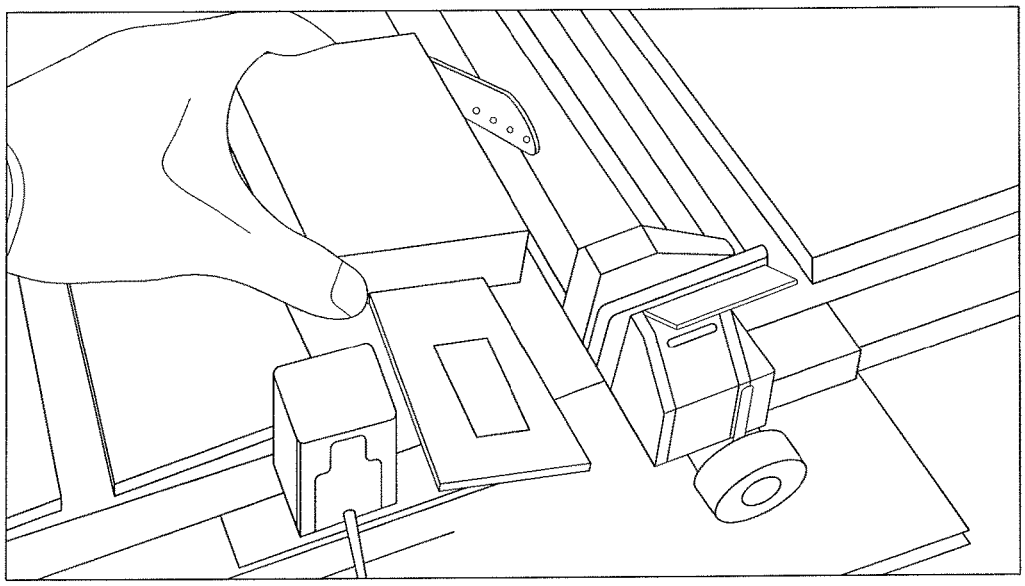
Figure 3C:
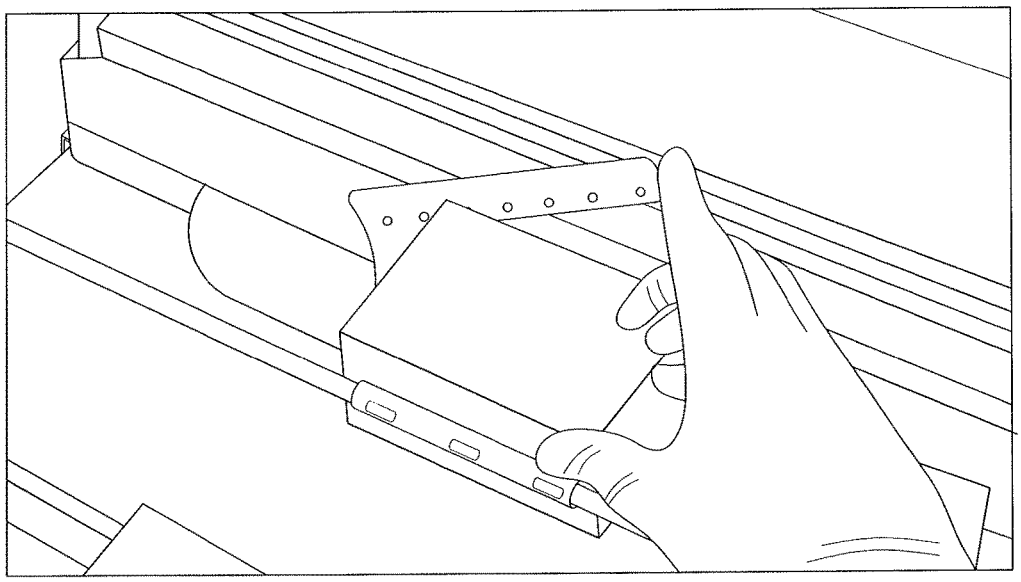

FIGS. 3A, 3B and 3C are a series of views showing the guard block and extension being rotated open to position the part, closed to press down on the part, and moved across the saw blade to trim the part, respectively. The part shown in the figures is a bracket with a three-dimensional shape that would be otherwise hard to control for trimming without the guide and safety guard. In the set-up shown, the table saw is used to trim a formed part with up to about 0.100 inch thickness of material to be removed in order to enable full control by the operator.

Figure 4:
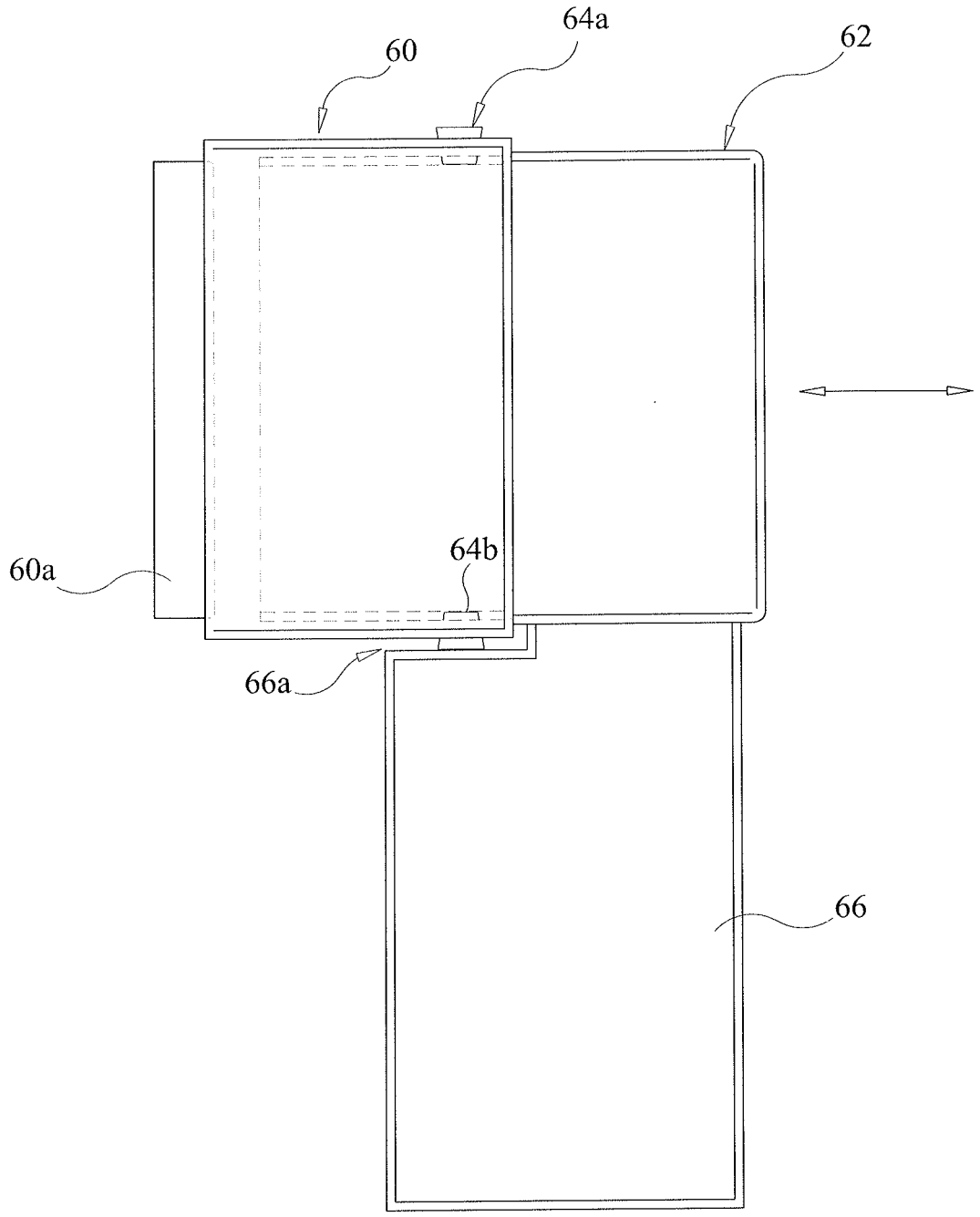
FIG. 4 shows an alternate embodiment of a guide and safety guard having a guard block portion that is adjustable in width.

In FIG. 4, an alternate embodiment of a guide and safety guard is shown having a guard block portion that is adjustable in width. A guard block has a base portion 60 and an adjustable portion 62 with a slightly smaller length so that it can be telescoped within the housing of the base portion 60.

When the adjustable portion 62 is set to the desired total width, set screws 64*a*, 64*b* on opposite sides of the base portion 60 are tightened to fix the adjustable portion 62 in position for the desired total width of the guard block. A guard extension 66 is attached to the adjustable portion 62 and has a cutout portion 66*a* for clearance around the housing of the base portion 60. The base portion 60 has a sleeve 60*a* attached for sliding on the support rail. In this embodiment, the total width of the guard block can be expanded by an amount of about the width of the base portion 60. For example for a base portion having a width of 3 inches, and an adjustable portion extending 1 inch from the base portion in the collapsed position, the guard block can be expanded continuously to a total width of 7 inches.

The guide and safety guard assembly can also be modified for use with a band saw and other types of power tools. For a band saw, the guard block may have a vertical flange extending upward a height sufficient to protect the hand of the operator from the side.

Many modifications and variations may of course be devised given the above description of preferred embodiments for implementing the principles in the present disclosure. It is intended that all such modifications and variations be considered as within the spirit and scope of this disclosure, as defined in the following claims.

The invention claimed is:

1. A table saw having a table top and a powered saw blade with an exposed portion of the saw blade projecting a given height above the table top for cutting a workpiece thereon, a movable guide fence positionable on the table top on a far side of the saw blade for guiding a far edge of the workpiece to be cut by the saw blade, the guide fence being movably mounted to movable side rails of the table saw, and a guide and safety guard comprising:

a support rail having opposite ends coupled to respective support members, the support members coupled to the movable side rails on a near side of the saw blade in a spaced relation to the guide fence for the width of the workpiece to be cut, such that the saw blade is positioned between the support rail and a front wall of the guide fence and such that a spacing between the support rail and the guide fence remains the same even if a position of the guide fence is adjusted relative to the saw blade;

a guard block mounted by a sleeve portion so as to be slidable on the support rail in axial directions thereon, and rotatable on the support rail so that the guard block can be moved out of and into operative position between the support rail and the guide fence to enable a user to press down manually on the workpiece, said guard block having a height projecting above the table top in the operative position that is greater than the height of the exposed portion of the saw blade for protecting the hand of the user pressing down thereon; and a guard extension fixed to a trailing side of the guard block having an extension length for protecting the wrist and lower arm area of the user.

2. A table saw according to claim 1, wherein the guard block has a width W that is less than a trimmed width of the workpiece but wide enough to allow manipulation close to the position of the saw blade.

3. A table saw according to claim 1, wherein the guard block is one of a set each having varying widths in increments.

4. A table saw according to claim 1, wherein the guard block is adjustable in width.

5. A table saw according to claim 4, wherein the guard block is formed by a base portion and an adjustable portion that is telescoped within a housing of the base portion, and fasteners for fixing the adjustable portion in position for a desired total width of the guard block.

6. A table saw according to claim 5, wherein the guard extension is attached to the adjustable portion and has a cutout portion extending from the trailing side of the adjustable portion for clearance around the housing of the base portion.

7. A table saw according to claim 1, wherein the trailing side of the guard block is positioned in a vertical direction, and the guard extension is fixed to the trailing side of the guard block proximate a horizontal top surface of the guard block and positioned to extend in a horizontal direction away from the trailing side.

8. A table saw according to claim 1, wherein the support members are removably coupled to the movable side rails.

9. A safety method for using a table saw having a table top and a powered saw blade with an exposed portion of the saw blade projecting a given height above the table top for cutting a workpiece thereon, and a movable guide fence positionable on the table top on a far side of the saw blade for guiding a far edge of the workpiece to be cut by the saw blade, the guide fence being mounted to movable side rails of the table saw, the method comprising:

coupling a support rail having opposite ends to respective support members to be coupled to the movable side rails on a near side of the saw blade in a spaced relation to the guide fence for the width of the workpiece to be cut such that the saw blade is positioned between the support rail and a front wall of the guide fence and such that a spacing between the support rail and the guide fence remains the same even if a position of the guide fence is adjusted relative to the saw blade;

positioning a guard block mounted by a sleeve portion so as to be slidable on the support rail in axial directions thereon with respect to the exposed portion of the saw blade, and rotatable on the support rail so that the guard block can be moved out of and into operative position between the support rail and the guide fence to enable a user to press down manually on the workpiece for cutting by the exposed portion of the saw blade, said guard block having a height projecting above the table top in the operative position that is greater than the height of the exposed portion of the saw blade for protecting the hand of the user pressing down thereon; and fixing a guard extension to a trailing side of the guard block, the guard extension having an extension length for protecting the wrist and lower arm area of the user.

10. The safety method for using a table saw according to claim 9, wherein the trailing side of the guard block is positioned in a vertical direction, and the guard extension is fixed to the trailing side of the guard block proximate a horizontal top surface of the guard block and positioned to extend in a horizontal direction away from the trailing side.

11. The safety method for using a table saw according to claim 9, wherein the support members are removably coupled to the movable side rails.

12. A table saw having a table top and a powered saw blade with an exposed portion of the saw blade projecting a given height above the table top for cutting a workpiece thereon, a movable guide fence positionable on the table top on a far side of the saw blade for guiding a far edge of the workpiece to be cut by the saw blade, and a guide and safety guard comprising:

a support rail having opposite ends coupled to respective support members, the support members coupled to the table top on a near side of the saw blade in a spaced relation to the guide fence for the width of the workpiece to be cut, such that the saw blade is positioned between the support rail and a front wall of the guide fence;

a guard block mounted by a sleeve portion so as to be slidable on the support rail in axial directions thereon, and rotatable on the support rail so that the guard block can be moved out of and into operative position between the support rail and the guide fence to enable a user to press down manually on the workpiece, said guard block having a height projecting above the table top in the operative position that is greater than the height of the exposed portion of the saw blade for protecting the hand of the user pressing down thereon and formed by a base portion and an adjustable portion that is telescoped within a housing of the base portion, and fasteners for fixing the adjustable portion in position for a desired total width of the guard block; and a guard extension fixed to a trailing side of the adjustable portion of the guard block and extending a length away from the trailing side of the adjustable portion of the guard block for protecting the wrist and lower arm area of the user, the guard extension having a cutout portion extending from the trailing side of the adjustable portion for clearance around the housing of the base portion.

13. A table saw according to claim 12, wherein the trailing side of the guard block is positioned in a vertical direction, and the guard extension is fixed to the trailing side of the guard block proximate a horizontal top surface of the guard block and positioned to extend in a horizontal direction away from the trailing side.

14. A table saw according to claim 12, wherein the guide fence is mounted to movable side rails of the table saw and the support members are removably coupled to the movable side rails such that a spacing between the support rail and the guide fence remains the same even if a position of the guide fence is adjusted relative to the saw blade.

15. A table saw according to claim 12, wherein the cutout portion of the guard extension provides clearance around the fasteners for fixing the adjustable portion.

* * * * *